US005383590A

United States Patent [19]

Ho

[11] Patent Number: 5,383,590

[45] Date of Patent: Jan. 24, 1995

[54] SAFETY FOOD WRAP FILM TEARING DEVICE

[75] Inventor: Hsiu-hui Ho, Hsi-chih, Taiwan, Prov. of China

[73] Assignee: Shih Chieh Hsu, Taiwan, Prov. of China

[21] Appl. No.: 126,639

[22] Filed: Sep. 27, 1993

[51] Int. Cl.[6] ..... B26F 3/02

[52] U.S. Cl. ..... 225/43; 225/52; 225/87

[58] Field of Search ..... 225/19, 33, 43, 52, 225/87, 20, 51, 82

[56] References Cited

U.S. PATENT DOCUMENTS

| | | | |
|---|---|---|---|
| 943,279 | 12/1909 | Smith | 225/43 X |
| 1,896,119 | 2/1933 | Wilson | 225/52 X |
| 2,613,879 | 10/1952 | Carr, Jr. | 225/52 X |
| 2,889,975 | 6/1959 | Hanlon | 225/19 |
| 3,843,034 | 10/1974 | Lewandowsky | 225/43 |
| 4,972,984 | 11/1990 | Frank et al. | 225/20 |
| 5,292,046 | 3/1994 | Kaiser et al. | 225/19 |

*Primary Examiner*—Richard K. Seidel
*Assistant Examiner*—Raymond D. Woods
*Attorney, Agent, or Firm*—Bacon & Thomas

[57] ABSTRACT

A safety food wrap film tearing device which mainly includes an upper cover having lateral inner side walls and a lower cover having lateral outer side walls and pivotally connected to the upper cover at a rear edge thereof such that a roll of food wrap film is contained in the space enclosed by the upper and the lower covers. The upper cover has an upper toothed tearing blade inside its free front end and the lower cover has a lower toothed tearing blade inside its free front end, abutting against an outer surface of the upper toothed tearing blade when the upper and the lower covers are closed. A press rib is provided inside the upper toothed tearing blade and a receiving rib corresponding to the press rib is provided inside the lower toothed tearing blade such that a length of outward pulled food wrap film can be clamped and pressed between the contacted press rib and receiving rib for stable tearing. A strip of pad is disposed at an inner surface of the lower toothed tearing blade to eliminate any static and to contact the upper toothed tearing blade so that the outward pulled food wrap film is conveniently, rapidly, safely and easily torn off from the entire roll of food wrap film contained in the two covers.

1 Claim, 3 Drawing Sheets

SAFETY FOOD WRAP FILM TEARING DEVICE

BACKGROUND OF THE INVENTION

The present invention relates to a safety food wrap film tearing device which has an upper cover and a lower cover pivotally connected together to contain a roll of food wrap film therein such that the food wrap film can be partially pulled out of it and be torn off along either an upper or a lower toothed blade attached to a free edge of the upper or the lower cover. The food wrap film tearing device of the present invention is further provided with an inside strip of pad inside and abutting against the lower toothed blade to eliminate any static electricity.

Presently, a most widely used food wrap film tearing device includes a paper-made box for containing a roll of food wrap film therein. The box is provided at one of its outer corners with a toothed strip. When a side wall of the box is lifted and the free end of the roll of food wrap film is pulled out of the box, the pulled part of food wrap film can be torn off along the toothed strip. The shortcomings which exist in such conventional food wrap film tearing device include:

1. Each time the food wrap film is torn by means of the toothed strip, the food wrap film is attracted to and therefore becomes attached to the toothed strip due to the static electricity generated on the toothed strip by the friction of food wrap film against the strip. When the static electricity disappears, the free end of the food wrap film might retract back into the box and stick to the roll when the roll of food wrap film rolls in the box. It is therefore necessary to repeatedly find and pull out the free end of the food wrap film each time the food wrap film is to be used. This is, of course, time-consuming;

2. The food wrap film can not always be torn straight with a desired neat edge;

3. The paper-made box could very possibly become collapsed before the entire roll of food wrap film is used up;

4. Since the toothed strip locates at an outer corner of the box, a user's hand is often accidently injured by it; and 5. Since the food wrap film is always torn in a direction from an upper position toward a lower position without any means to fix the roll of food wrap film in the box, the food wrap film is apt to be undesirably pulled out of the box, that is, the food wrap film tearing device is inconvenient in use.

It is therefore tried by the applicant to develop a safety food wrap film tearing device which can be easily, safely, and conveniently operated to eliminate the shortcomings in the conventional food wrap film tearing device.

SUMMARY OF THE INVENTION

It is a primary object of the present invention to provide a safety food wrap film tearing device which can be easily, conveniently, safely, and effectively used to tear a desired length of food wrap film off an entire roll of food wrap film.

Another object of the present invention is to provide the above safety food wrap film tearing device which prevents static electricity from being generated on its toothed tearing blades.

The safety food wrap film tearing device according to the present invention mainly has upper and lower covers pivotally connected together at a pair of edges thereof to contain a roll of food wrap film therebetween. At a free edge opposite to the pivotally connected edge of each of the covers, a toothed tearing blade is provided such that the toothed tearing blade of the upper cover extend downward to abut against an inner side of the upward extended toothed tearing blade of the lower cover. A press rib of the upper cover near an inner side of the upper toothed tearing blade just corresponds to a receiving rib of the lower cover near an inner side of the lower toothed tearing blade such that a free end of the food wrap film is fixedly located between the contacted press rib and receiving rib. A strip of pad is further disposed at an inner side of the lower toothed tearing blade to just contact a bottom edge of the upper toothed tearing blade to eliminate the generation of static electricity on the toothed tearing blades.

BRIEF DESCRIPTION OF THE DRAWINGS

The other features, objects and advantages of the present invention can be best understood through the following detailed description of the preferred embodiment and the accompanying drawings, wherein.

DETAILED DESCRIPTION OF THE PREFERRED EMBODIMENTS

Figure 1:
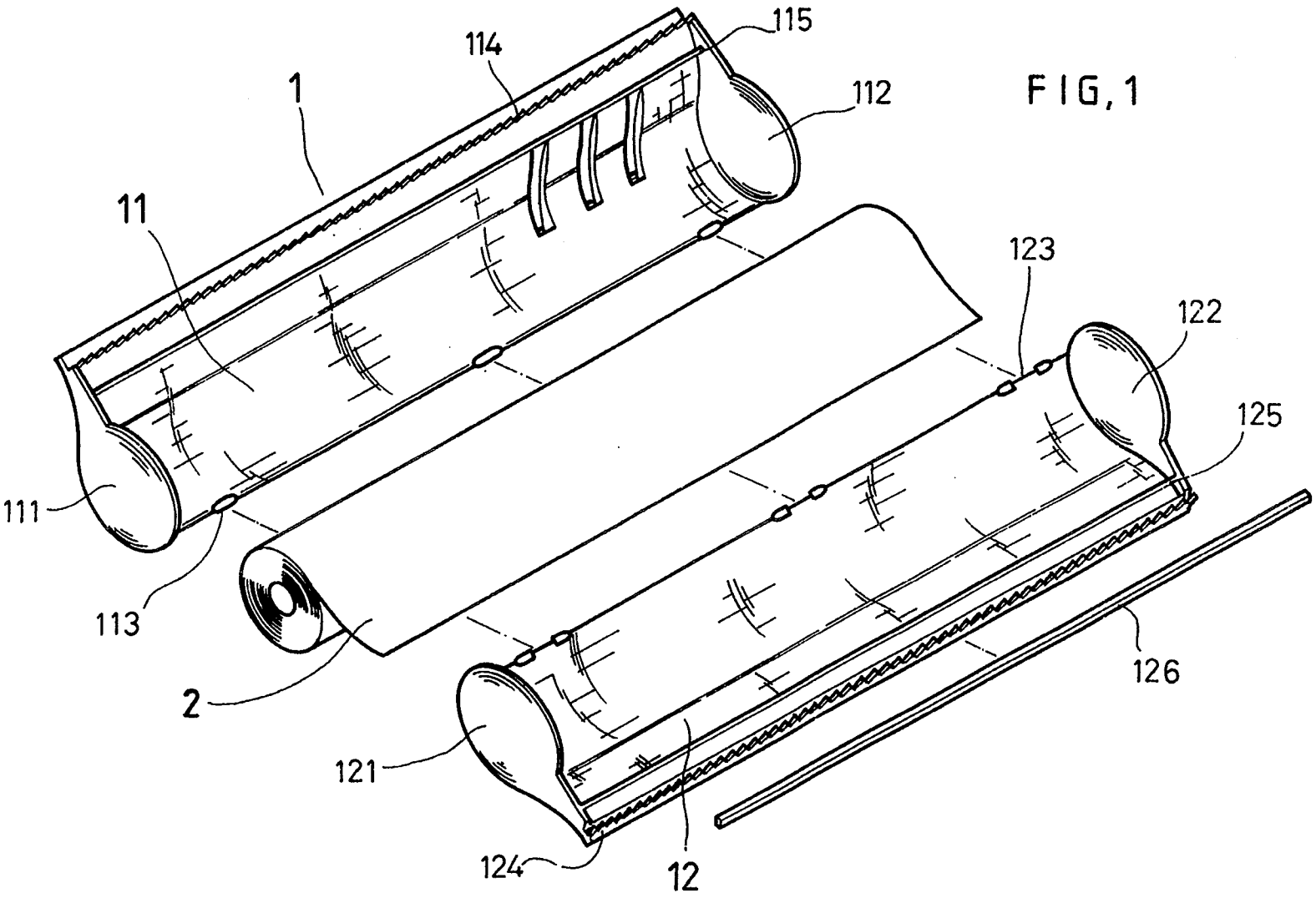
FIG. 1 is a disassembled perspective view of the present invention.
Figure 2:
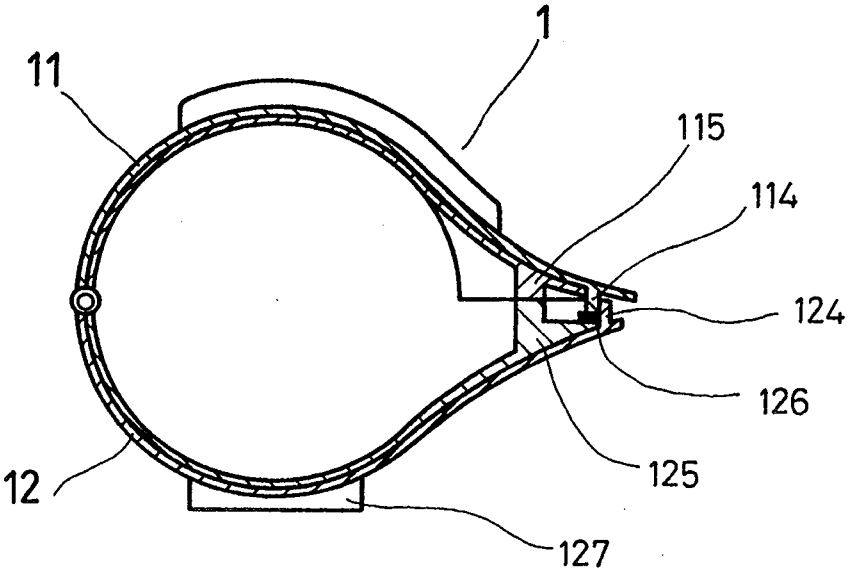
FIG. 2 is a vertical side sectional view of the present invention wherein the upper and the lower covers are closed to contact each other.

Please refer to FIG. 1. The present invention is a food wrap film tearing device 1 comprising an upper cover 11 having a plurality of projections 113 formed at a rear edge thereof and a lower cover 12 having a plurality of receiving members 123 corresponding to the projections 113. The engagement of the projection 113 with the receiving members 123 enables the upper cover 11 to pivotally connect to the lower cover 12 to enclose a space for containing a roll of food wrap film 2 therein. The upper cover 11 is provided with a pair of spaced inner lateral side walls 111, 112 and the lower cover 12 is provided with a pair of spaced outer lateral side walls 121, 122 to confine the roll of food wrap film 2 within the upper and the lower covers 11, 12. The upper cover 11 is further provided at its front lower edge with an upper toothed tearing blade 114 and the lower cover 12 is provided at its front upper edge with a lower toothed tearing blade 124 such that when the upper and the lower covers 11, 12 are closed, the lower toothed tearing blade 124 just locates at and abuts against an outer surface of the upper toothed tearing blade 114. A press rib 115 is provided inside the upper cover 11 to transversely cross the upper cover 11 and is parallel to the upper toothed tearing blade 114. A receiving rib 125 corresponding to the press rib 115 is provided inside the lower cover 12 to transversely cross the lower cover 12 and is parallel to the lower toothed tearing blade 124 such that the contact of the press rib 115 with the receiving rib 125 at the time the upper and the lower covers 11, 12 are closed can fixedly clamp a length of outward pulled food wrap film 2 therebetween. To eliminate the static electricity generated on the upper and the lower toothed tearing blades 114, 124 and prevent the food wrap film 2 from sticking to the toothed tearing blades 114, 124, a strip of pad 126 is provided to abut against an inner side of the lower toothed tearing blade 124 such that the strip of pad 126 is pressed against a bottom edge of the upper toothed tearing blade 114 when the two covers 11, 12 are closed.

Figure 3:
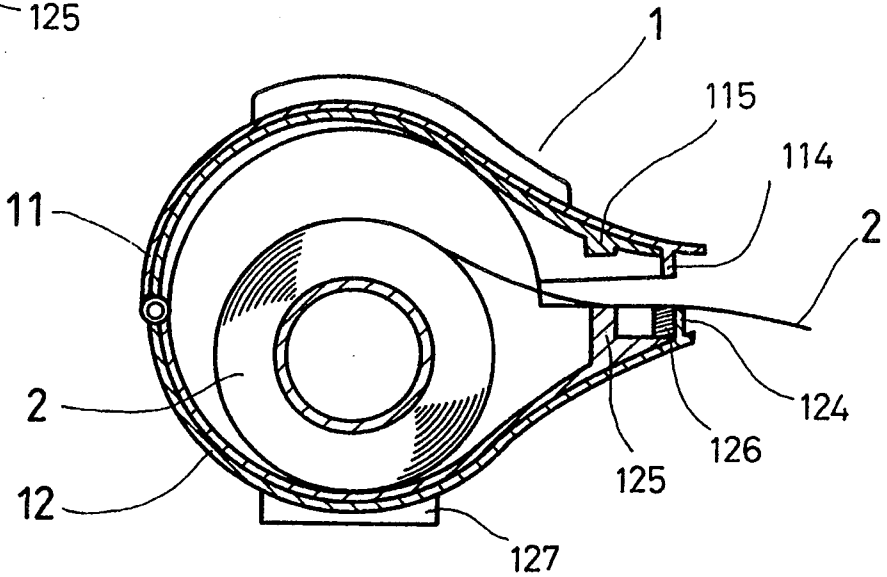
FIG. 3 is a vertical side sectional view of the present invention wherein the upper and the lower covers are opened to separate from each other and a roll of food wrap film is contained between the covers with a free end thereof pulled out of the covers.

Please refer to FIGS. 1 and 3. When the upper and the lower covers 11, 12 of the food wrap film tearing device 1 are closed, the roll of food wrap film 2 is contained in the space enclosed by the upper and the lower covers 11, 12, the press rib 115 of the upper cover 11 presses against the receiving rib 125 of the lower cover 12, and the upper toothed tearing blade 114 presses against the strip of pad 126 of the lower cover 12, enabling a length of outward pulled food wrap film 2 to be either pulled upward and thereby cut by the upper toothed tearing blade 114 without generating any static or pulled downward and thereby cut by the lower toothed tearing blade 124. When the food wrap film tearing device 1 is to be used again, the upper and the lower covers 11, 12 can be opened with the outward pulled food wrap film 2 still remaining between the press rib 115 and the receiving rib 125. Since the upper and the lower covers 11, 12 have a substantially arched cross section, a free end of the roll of food wrap film 2 can be easily and conveniently pulled out of the covers 11, 12, or an old roll of food wrap film 2 can be conveniently replaced with a new one. A seat 127 having a flat bottom surface can be provided at the bottom portion of the lower cover 12 so that the food wrap film tearing device 1 of the present invention can be steadily positioned.

Figure 4:
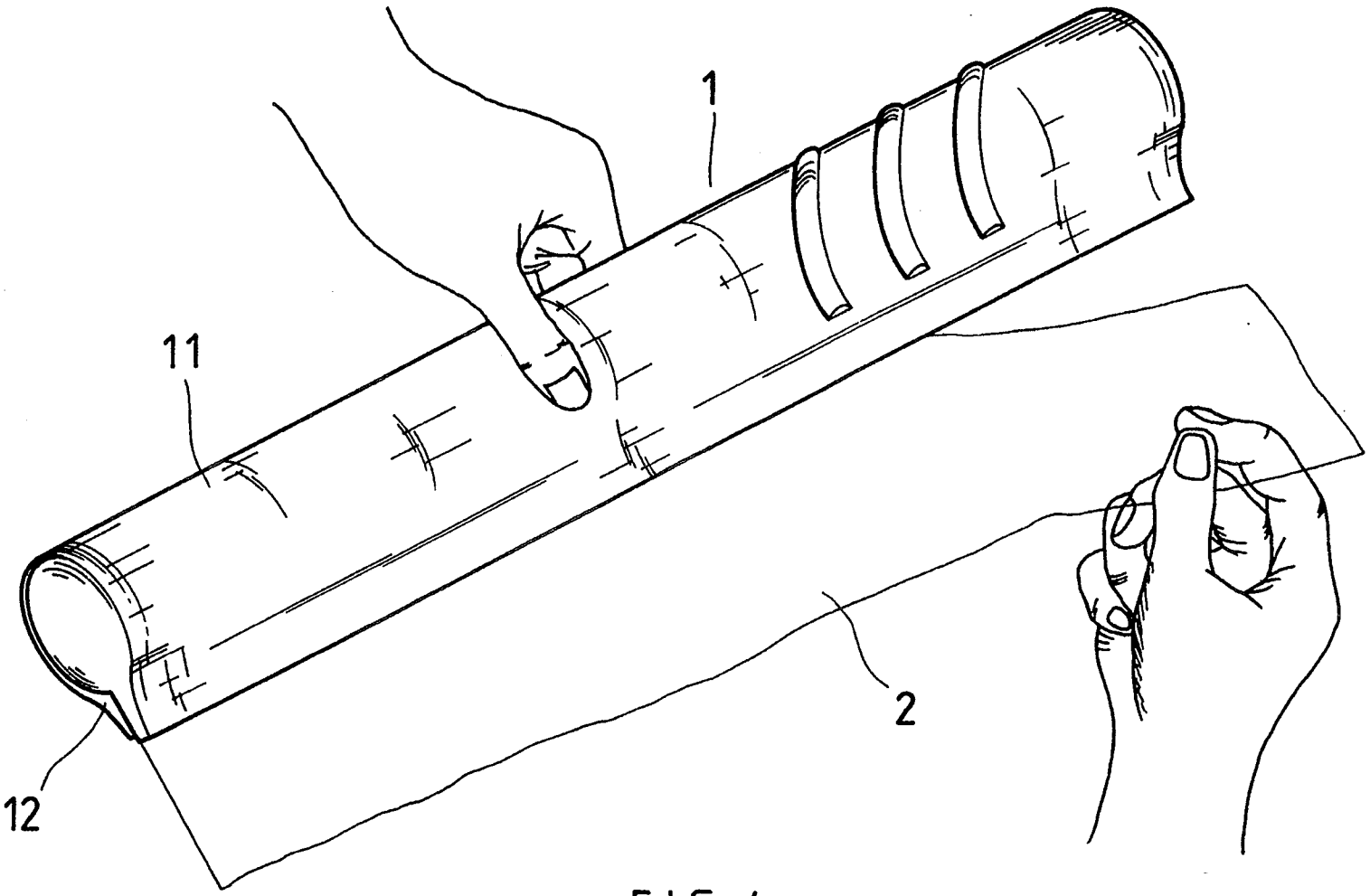
FIG. 4 illustrates an assembled food wrap film tearing device of the present invention in use.

Please refer FIG. 4. When using the present invention to tear off a length of food wrap film 2 from the entire roll contained inside the upper and the lower covers 11, 12, just grip the closed upper and lower covers 11, 12 with one hand while hold the outward pulled food wrap film 2 with another hand, then tear the outward stretched food wrap film 2 upward or downward and the food wrap film 2 is conveniently, rapidly, stably and neatly cut. Since the free edges of the upper and the lower covers to where the toothed tearing blades 114, 124 are disposed is in a tapered form relative to the rear edge, the blades with not easily injure the user's hand, so, the food wrap film tearing device of the present invention is safer in use.

What is claimed is:

1. A safety food wrap film tearing device comprising an upper cover having a plurality of projections formed at a rear edge thereof and a lower cover having a plurality of receiving members corresponding to said projections of said upper cover such that said lower cover is pivotally connected to said upper cover by engaging said receiving members with said projections, said upper and said lower covers having lateral inner and outer side walls, respectively, to confine a roll of food wrap film within a space enclosed by said upper and said lower covers, said upper cover having an upper toothed tearing blade provided at a front bottom edge thereof and a press rib provided near an inner side of and parallel to said upper toothed tearing blade, and said lower cover having a lower toothed tearing blade provided at a front upper edge thereof to just abut against an outer surface of said upper toothed tearing blade when said upper and said lower covers are closed, a receiving rib provided near an inner side of and parallel to said lower toothed tearing blade to just contact said press rib of said upper cover, and a strip of pad abutting against an inner surface of said lower toothed tearing blade to just press against a bottom edge of said upper toothed tearing blade when said upper and said lower covers are closed.

* * * * *